US010309604B2

(12) United States Patent
Song et al.

(10) Patent No.: US 10,309,604 B2
(45) Date of Patent: Jun. 4, 2019

(54) HEADLAMP WITH SECURED VIEW

(71) Applicant: HYUNDAI MOBIS CO., LTD., Seoul (KR)

(72) Inventors: Ki Ryong Song, Yongin-si (KR); Gun Duk Kim, Yongin-si (KR); Hyung Rok Shim, Seoul (KR)

(73) Assignee: Hyundai Mobis Co., Ltd., Seoul (KR)

( * ) Notice: Subject to any disclaimer, the term of this patent is extended or adjusted under 35 U.S.C. 154(b) by 0 days.

(21) Appl. No.: 15/987,280

(22) Filed: May 23, 2018

(65) Prior Publication Data

US 2018/0340666 A1 Nov. 29, 2018

(30) Foreign Application Priority Data

May 23, 2017 (KR) ..... 10-2017-0063419

(51) Int. Cl.

| | |
|---|---|
| ***F21S 41/275*** | (2018.01) |
| ***F21S 41/265*** | (2018.01) |
| ***F21S 41/32*** | (2018.01) |
| ***F21V 5/00*** | (2018.01) |
| ***F21S 41/20*** | (2018.01) |
| *F21S 41/143* | (2018.01) |

(52) U.S. Cl.

CPC ..... *F21S 41/275* (2018.01); *F21S 41/265* (2018.01); *F21S 41/285* (2018.01); *F21S 41/322* (2018.01); *F21V 5/008* (2013.01); *F21S 41/143* (2018.01)

(58) Field of Classification Search

CPC ..... F21S 41/275; F21S 41/285; F21S 41/265; F21S 41/322; F21V 5/008

See application file for complete search history.

(56) References Cited

U.S. PATENT DOCUMENTS

| | | | | |
|---|---|---|---|---|
| 8,469,567 | B2 * | 6/2013 | Futami | B60Q 1/0041 362/545 |
| 8,668,351 | B2 * | 3/2014 | Dubuc | F21V 5/045 362/235 |
| 9,429,292 | B2 | 8/2016 | Choi et al. | |
| 2002/0034081 | A1 * | 3/2002 | Serizawa | B60Q 1/2696 362/540 |
| 2004/0076396 | A1 * | 4/2004 | Suga | G02B 6/0036 385/146 |
| 2007/0263400 | A1 * | 11/2007 | Walser | B60R 1/1207 362/494 |

(Continued)

FOREIGN PATENT DOCUMENTS

| | | |
|---|---|---|
| JP | 9-237431 | 9/1997 |
| JP | 2011-108413 | 6/2011 |
| JP | 2013-246944 | 12/2013 |

(Continued)

*Primary Examiner* — Tracie Y Green

(74) *Attorney, Agent, or Firm* — H.C. Park & Associates, PLC

(57) ABSTRACT

A lighting device for a vehicle may include: a lamp part configured to irradiate light; an inducing lens part configured to guide the light irradiated from the lamp part, and having a cut surface formed thereon; an adjusting lens part formed at the front of the inducing lens part, and configured to adjust the direction of the light moved through the inducing lens part; and a light scattering part formed on the cut surface so as to prevent glare caused by light incident on the cut surface.

11 Claims, 7 Drawing Sheets

(56) References Cited

U.S. PATENT DOCUMENTS

2010/0110716 A1* 5/2010 Nakada ..... F21S 41/147
362/538

FOREIGN PATENT DOCUMENTS

| | | |
|---|---|---|
| JP | 2014-060047 | 4/2014 |
| JP | 2016-213014 | 12/2016 |
| KR | 10-0401263 | 10/2003 |
| KR | 10-1397602 | 5/2014 |

* cited by examiner

HEADLAMP WITH SECURED VIEW

CROSS-REFERENCE TO RELATED APPLICATION

This application claims priority from and the benefit of Korean Patent Application No. 10-2017-0063419, filed on May 23, 2017, which is hereby incorporated by reference for all purposes as if set forth herein.

BACKGROUND

Field

Exemplary embodiments relates to a lighting device for a vehicle, and more particularly, to a lighting device for a vehicle, which can guarantee straight propagation of light, and prevent a glare problem to meet regulations.

Discussion of the Background

In general, a lighting device for a vehicle irradiates light in order to prevent a safety accident of the vehicle. In particular, a headlamp of the lighting device for a vehicle irradiates light forward, in order to secure a forward view.

The lighting device for a vehicle includes a lamp for irradiating light and a lens for controlling the direction of light. At this time, the lens may induce light to a single point, in order to secure a driver's view. The lens may have a cut surface formed at the edge thereof.

However, when a part of light irradiated from the lamp is incident on the cut surface, the light may dazzle a driver coming in the opposite direction. Therefore, there is a demand for a structure capable of solving the problem.

The above information disclosed in this Background section is only for enhancement of understanding of the background of the invention and, therefore, it may contain information that does not constitute prior art.

SUMMARY

Exemplary embodiments of the present invention provide a lighting device for a vehicle, which can guarantee straight propagation of light, and prevent a glare problem to meet regulations.

In one embodiment, a lighting device for a vehicle may include: a lamp part configured to irradiate light; an inducing lens part configured to guide the light irradiated from the lamp part, and having a cut surface formed thereon; an adjusting lens part formed at the front of the inducing lens part, and configured to adjust the direction of the light moved through the inducing lens part; and a light scattering part formed on the cut surface so as to prevent glare caused by light incident on the cut surface.

The inducing lens part may include a multi-stage total internal reflection lens, and the cut surface may be formed so as to correspond to the size of the adjusting lens.

The cut surface may include an outer cut surface and an inner cut surface.

The upper and lower end portions and left and right end portions of the inducing lens part may be cut so as to correspond to the top-to-bottom width and side-to-side width of the adjusting lens part, such that the outer cut surface is formed.

The inner end portion of the inducing lens part may be cut so as to correspond to the size of the lamp part, such that the inner cut surface is formed.

The inner end portion of the inducing lens part may be cut so as to correspond to the size of the lamp part, such that the inner cut surface is formed.

The adjusting lens part may form a low beam pattern by adjusting the direction of light through multiple surfaces.

The light scattering part may be applied on the cut surface, and have a rough surface.

The light scattering part may have a surface roughness of 15 to 70 μm.

The lighting device may further include a light cover part surrounding the inducing lens part, and restricting movement of light incident on the cut surface.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
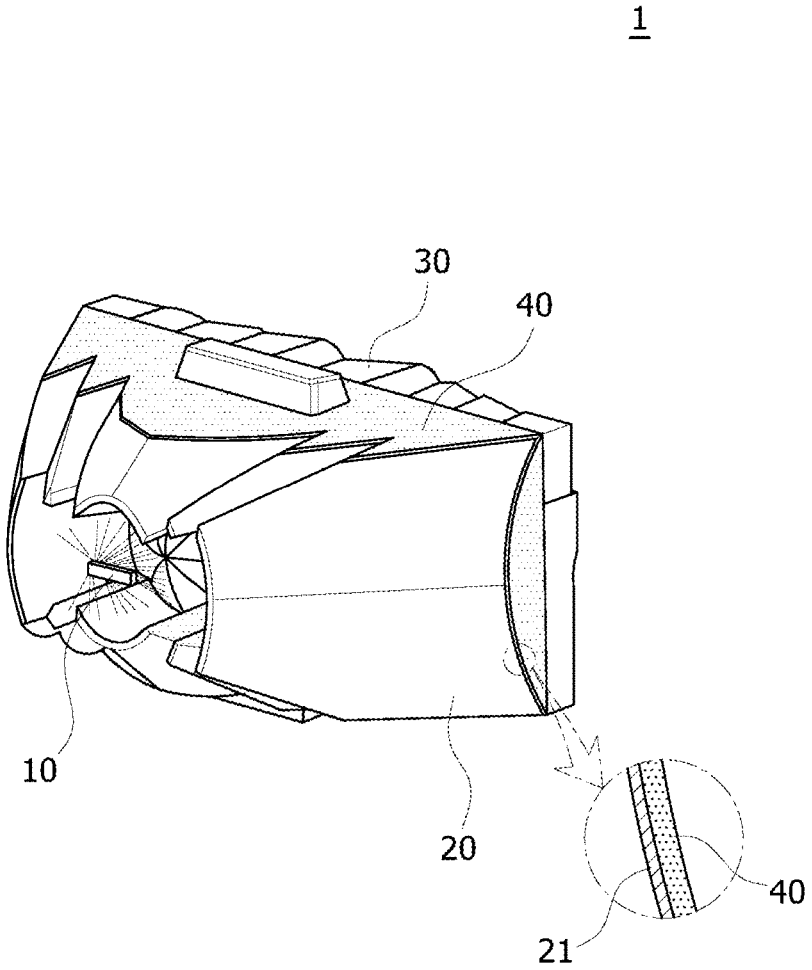
FIG. 1 schematically illustrates a lighting device for a vehicle in accordance with an embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. Like reference numerals in the drawings denote like elements.

Embodiments of the invention will hereinafter be described in detail with reference to the accompanying drawings. It should be noted that the drawings are not to precise scale and may be exaggerated in thickness of lines or sizes of components for descriptive convenience and clarity only. Furthermore, the terms as used herein are defined by taking functions of the invention into account and can be changed according to the custom or intention of users or operators. Therefore, definition of the terms should be made according to the overall disclosures set forth herein.

It will be understood that for purposes of this disclosure, "at least one of X, Y, and Z" can be construed as X only, Y only, Z only, or any combination of two or more items X, Y, and Z (e.g., XYZ, XYY, YZ, ZZ). Unless particularly described to the contrary, the term "comprise", "configure", "have", or the like, which are described herein, will be understood to imply the inclusion of the stated components, and therefore should be construed as including other components, and not the exclusion of any other elements.

FIG. 1 schematically illustrates a lighting device for a vehicle in accordance with an embodiment of the present invention. Referring to FIG. 1, the lighting device 1 for a vehicle in accordance with the embodiment of the present invention may include a lamp part 10, an inducing lens part 20, an adjusting lens part 30 and a light scattering part 40.

The lamp part 10 may irradiate light. For example, an LED may be used as the lamp part 10, and the lamp part 10 may generate light as power is applied.

The inducing lens part 20 may guide the light irradiated from the lamp part 10. The inducing lens part 20 may have a radius of curvature to induce the light irradiated from the lamp part 10 to the adjusting lens part 30. The inducing lens part 20 may have a cut surface 21 formed at the inside and edge thereof, the cut surface 21 being formed by a cutting process.

The adjusting lens part 30 may be formed at the front of the inducing lens part 20, and adjust the direction of light moved through the inducing lens part 20. For example, the adjusting lens part 30 may induce the light moved through the inducing lens part 20 in a target direction.

The direction of light incident on the cut surface 21 of the inducing lens part 20 may not be adjusted by the adjusting lens part 30, but the light may cause a glare problem. The light scattering part 40 may be formed on the cut surface 21, and scatter the light incident on the cut surface 21, thereby preventing a glare problem.

Figure 2A:
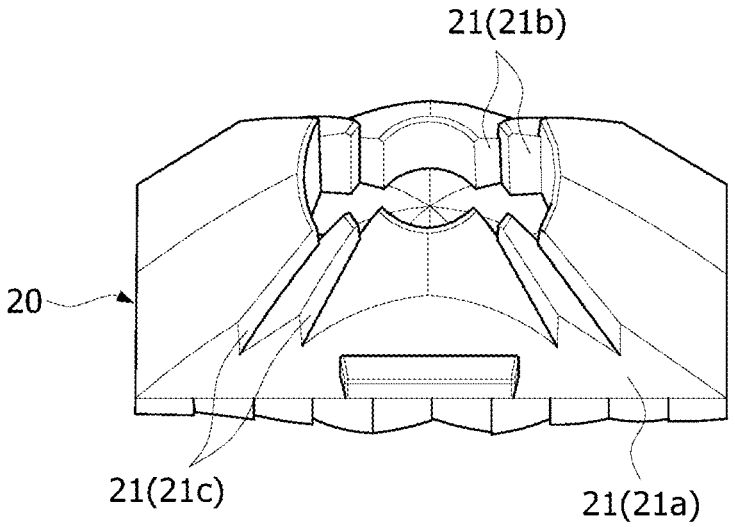
FIGS. 2A to 2C schematically illustrate an inducing lens part of the lighting device for a vehicle in accordance with the embodiment of the present invention.
Figure 2B:
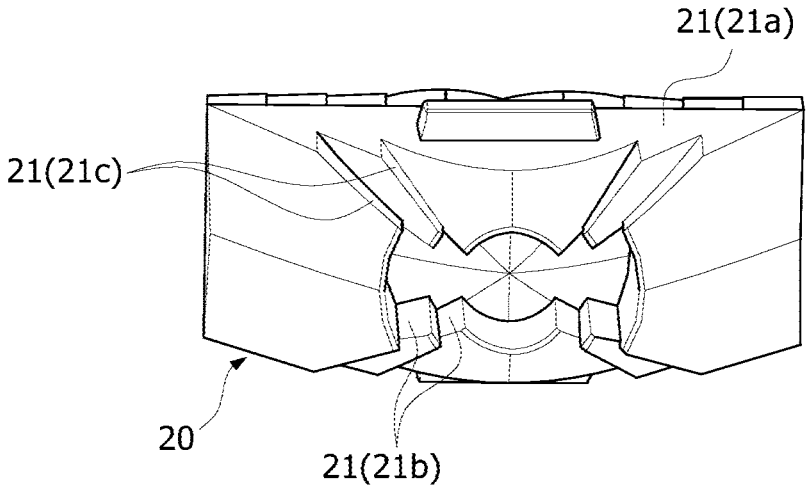
Figure 2C:
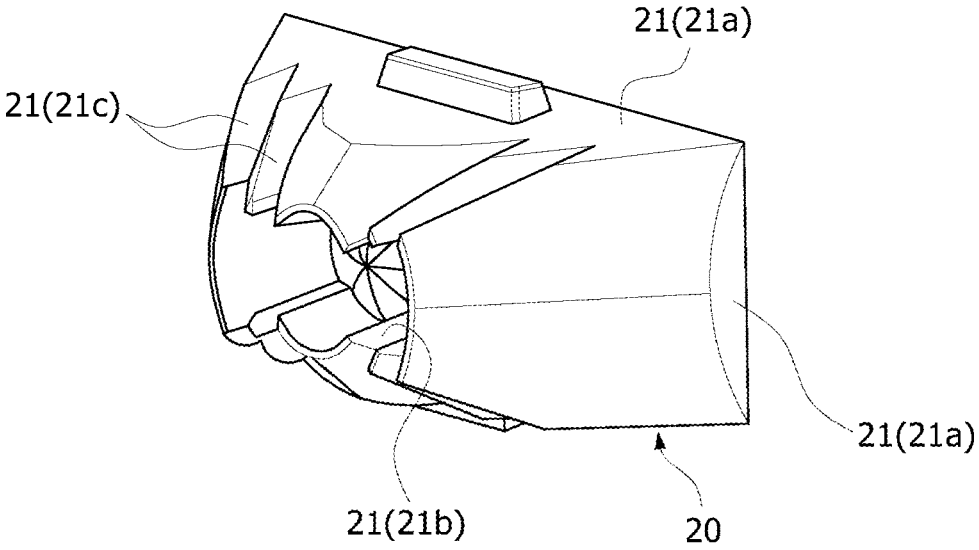

FIGS. 2A to 2C schematically illustrate the inducing lens part of the lighting device for a vehicle in accordance with the embodiment of the present invention. Referring to FIGS. 1 and 2, the inducing lens part 20 in accordance with the embodiment of the present invention may include a multi-stage total internal reflection lens. Since the inside and edge of the inducing lens part 20 are cut according to an installation environment, the inside and edge of the inducing lens part 20 may have the cut surface 21. The cut surface 21 may include an outer cut surface 21*a* and an inner cut surface 21*b*.

FIG. 2A is a bottom perspective view of the inducing lens part 20, FIG. 2B is a plan perspective view of the inducing lens part 20, and FIG. 2C is a side perspective view of the inducing lens part 20. As illustrated in FIGS. 2A to 2C, a three-stage total internal reflection lens with a radius of curvature may be employed as the inducing lens part 20, and the inducing lens part 20 may change light irradiated from the lamp part 10 into straight light. The upper and lower end portions and left and right end portions of the inducing lens part 20 may be cut according to the top-to-bottom width and side-to-side width of the adjusting lens part 30, such that the outer cut surface 21*a* is formed. The inner end portion of the inducing lens part 20 may be cut according to the size and installation position of the lamp part 10, such that the inner cut surface 21*b* is formed. At this time, the inner end portion of the inducing lens part 20 may be adjacent to the lamp part 10, and surround the lamp part 10.

The cut surface 21 may further include a layered cut surface 21*c*. The layered cut surface 21*c* may correspond to faults formed in the three-stage total internal reflection lens. That is, when circular total internal reflection lenses having three different diameters are formed as one total internal reflection lens, faults may be formed at connection portions between the respective total reflection lenses. Such faults may be referred to as the layered cut surface 21*c*.

Figure 3:
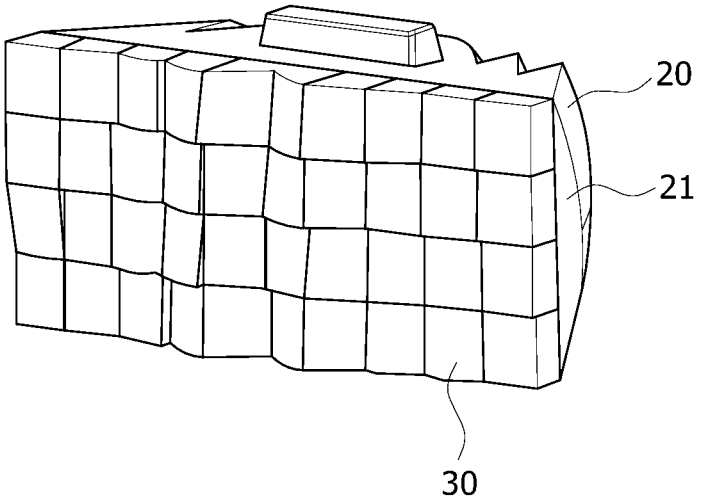
FIG. 3 schematically illustrates an adjusting lens part of the lighting device for a vehicle in accordance with the embodiment of the present invention.

FIG. 3 schematically illustrates the adjusting lens part of the lighting device for a vehicle in accordance with the embodiment of the present invention. Referring to FIGS. 1 to 3, the adjusting lens part 30 in accordance with the embodiment of the present invention may form a low beam pattern by adjusting the direction of light through multiple surfaces. For example, light may be changed into straight light by the inducing lens part 20, and then concentrated on a designed point through the surfaces formed on the adjusting lens part 30, thereby serving as a low beam.

Figure 4:
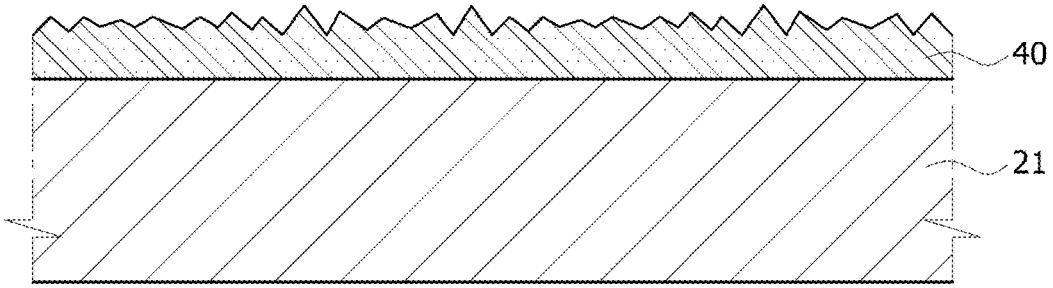
FIG. 4 schematically illustrates a light scattering part of the lighting device for a vehicle in accordance with the embodiment of the present invention.

FIG. 4 schematically illustrates the light scattering part of the lighting device for a vehicle in accordance with the embodiment of the present invention. Referring to FIGS. 1 and 4, the light scattering part 40 in accordance with the embodiment of the present invention may be applied to the cut surface 21, and have a rough surface.

For example, the light scattering part 40 may be formed by coating the cut surface 21 with a corrosive agent used for a corrosion treatment, and have a surface roughness of 15 to 70 μm. The light scattering part 40 with such a surface roughness may scatter light incident on the cut surface 21, thereby preventing the light from dazzling a driver coming in the opposite direction. In another embodiment, the light scattering part 40 may include a reflecting plate which is attached to the cut surface 21 so as to reflect light.

Figure 5:
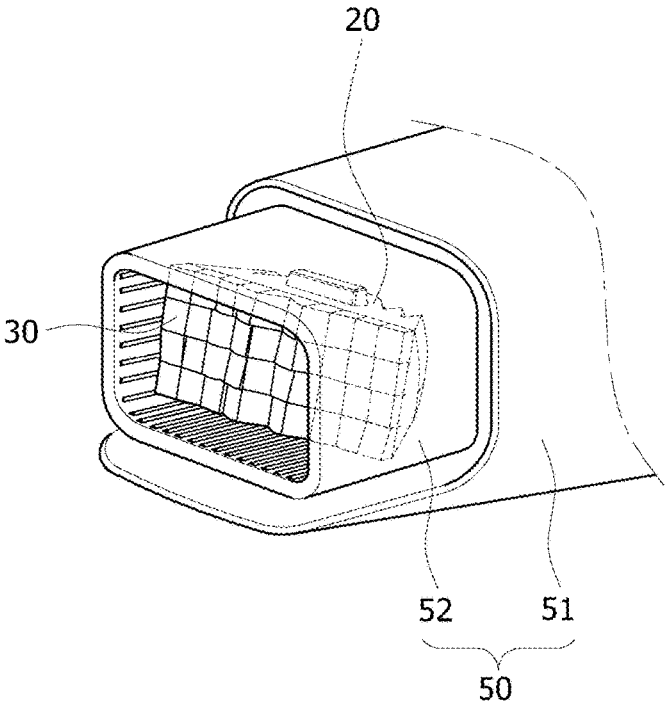
FIG. 5 schematically illustrates a light cover part of the lighting device for a vehicle in accordance with the embodiment of the present invention.

FIG. 5 schematically illustrates a light cover part of the lighting device for a vehicle in accordance with the embodiment of the present invention. Referring to FIGS. 1 and 5, the lighting device 1 for a vehicle in accordance with the present embodiment may further include the light cover part 50.

The light cover part 50 may cover the inducing lens part 20 so as to restrict the movement of light incident on the cut surface 21. Therefore, the light cover part 50 can prevent a glare problem caused by light incident on the cut surface 21.

For example, the light cover part 50 may include a cover housing part 51 and a cover prevention part 52. The cover housing part 51 may be mounted on the vehicle body, and the lamp part 10 including a substrate may be mounted in the cover housing part 51. The cover prevention part 52 may be mounted on the cover housing part 51, and cover the inducing lens part 20 and the adjusting lens part 30. That is, the cover prevention part 52 may be formed in a duct shape to cover the edge of the inducing lens part 20. Therefore, the cut surface 21 of the inducing lens part 20 may be brought in contact with the cover prevention part 52. The cover prevention part 52 may be formed of a material which absorbs or reflects light, and prevent light from dazzling a driver in the opposite direction, the light being incident on the cut surface 21.

Figure 6A:
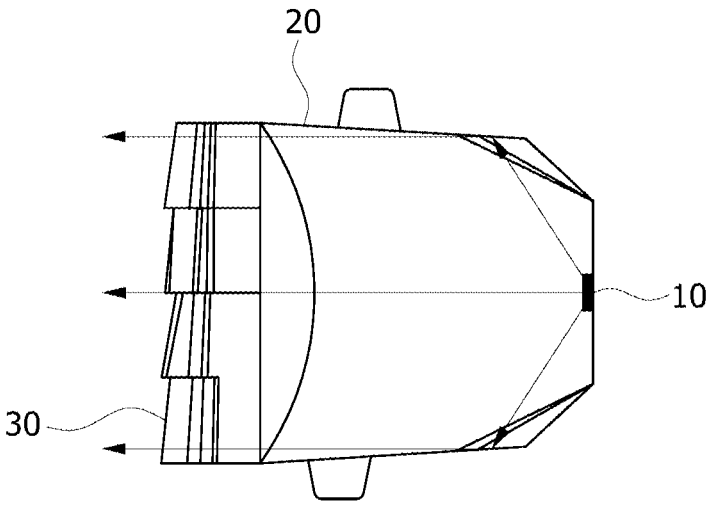
FIGS. 6A to 6C schematically illustrates an optical path of the lighting device for a vehicle in accordance with the embodiment of the present invention.
Figure 6B:
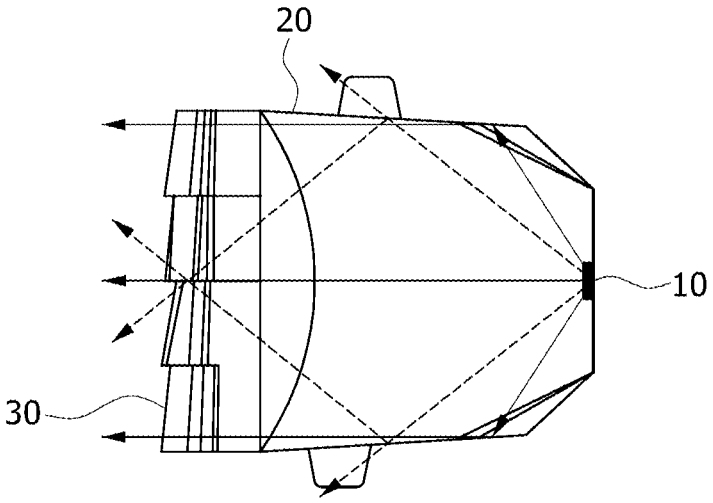
Figure 6C:
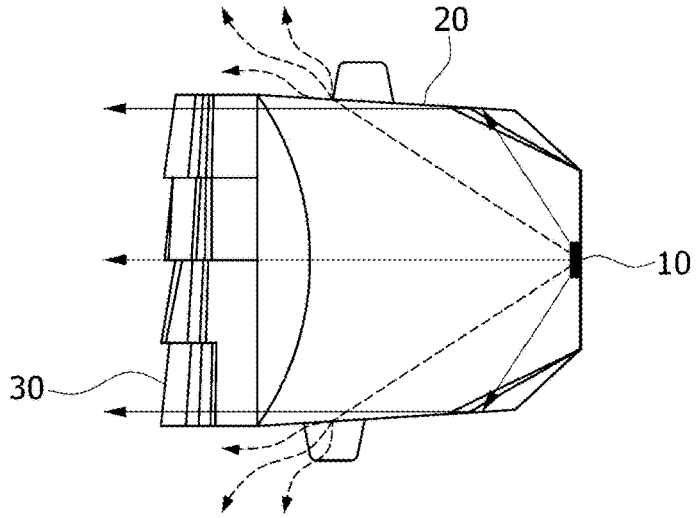

FIGS. 6A to 6C schematically illustrates an optical path of the lighting device for a vehicle in accordance with the embodiment of the present invention. Referring to FIGS. 6A to 6C, the optical path will be described as follows.

When the lamp part 10 is turned on, a part of light irradiated from the lamp part 10 may be moved straight forward by the inducing lens part 20 (FIG. 6A). Furthermore, when light irradiated from the lamp part 10 reaches the cut surface 21 of the inducing lens part 20, a part of the light may be totally reflected on the cut surface 21, and the rest of the light may become direct light to dazzle a driver in the opposite direction (FIG. 6B). However, when the light scattering part 40 is formed on the cut surface 21, light having passed through the cut surface 21 may be scattered and prevented from dazzling a driver in the opposite direction.

Figure 7A:
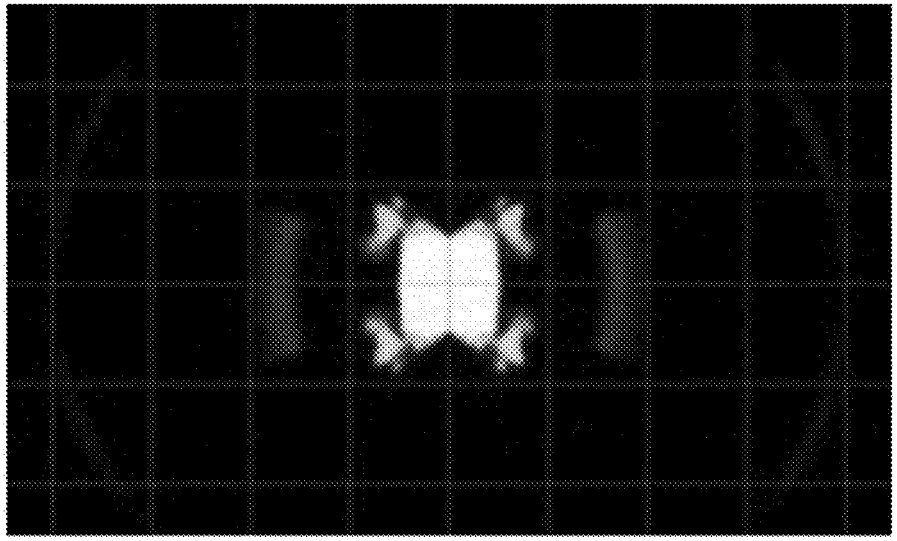
FIGS. 7A to 7C schematically illustrate simulation results of the lighting device for a vehicle in accordance with the embodiment of the present invention.
Figure 7B:
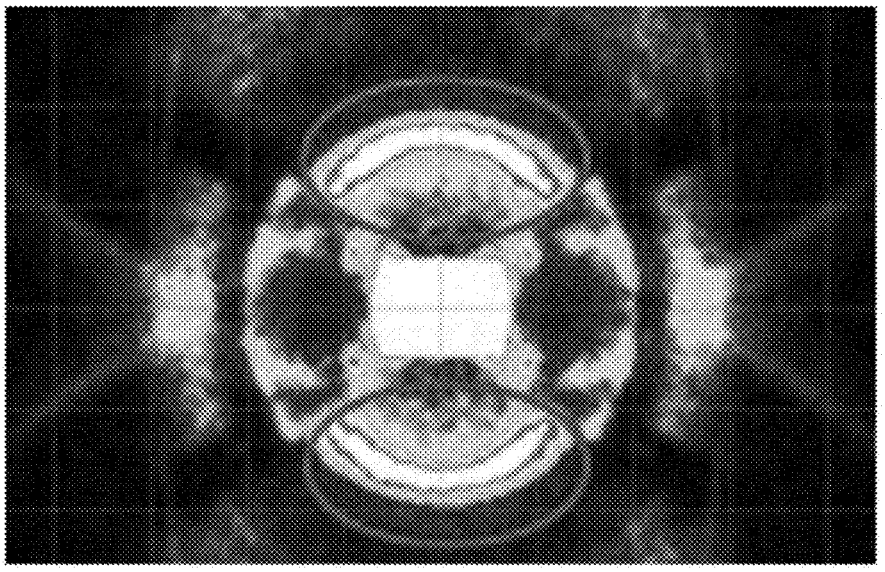
Figure 7C:
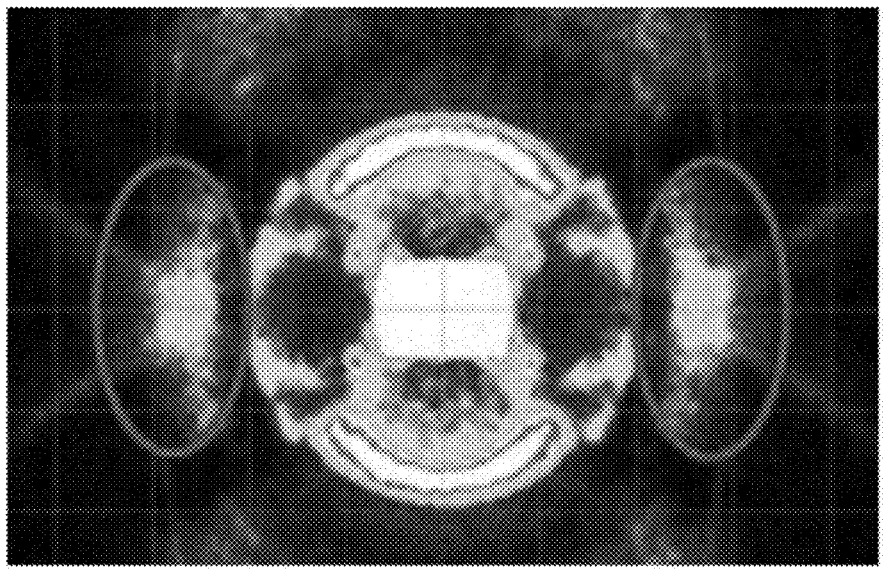

FIGS. 7A to 7C schematically illustrate simulation results of the lighting device for a vehicle in accordance with the embodiment of the present invention. Referring to FIGS. 7A to 7C, the simulation results will be described as follows.

When the light scattering part 40 is formed on the cut surface 21 formed at the inside and edge of the inducing lens part 20, a beam pattern may be formed as illustrated in FIG. 7A, thereby preventing a glare problem. However, when the light scattering part 40 is not formed on the cut surface 21, a beam pattern may be formed as illustrated in FIG. 7B or 7C. In such a beam pattern, unintended light may be irradiated at top and bottom and right and left sides, thereby dazzling a driver in the opposite direction. That is, when the light scattering part 40 is not formed on the cut surface 21 formed at the edge of the inducing lens part 20, a beam pattern may be formed as indicated by a circle in FIG. 7B. Furthermore, when the light scattering part 40 is not formed on the cut surface 21 formed at the inside of the inducing lens part 20, a beam pattern may be formed as indicated by a circle in FIG. 7C. Since the beam pattern indicated by a circle has a constant direction at an intensity of 120 cd or more, the beam pattern may dazzle a driver in the opposite direction, thereby having an influence on the regulations and safety accident. However, when the light scattering part 40 is formed on the cut surface 21, the light scattering part 40 can suppress a glare problem while the intensity of a beam pattern which is scattered and formed becomes 50 cd or less.

The operation of the lighting device for a vehicle in accordance with the embodiment of the present invention will be described as follows.

The edge of the inducing lens part 20 constituted by a multilayer total internal reflection lens may be cut to form the cut surface 21, and the adjusting lens part 30 may be disposed at the front of the inducing lens part 20. At this time, the cut surface 21 may be formed on the inducing lens part 20, according to the size of the adjusting lens part 30.

When the inducing lens part 20 and the adjusting lens part 30 are integrated with each other, the cut surface 21 may be coated with the light scattering part 40. The light scattering part 40 may have a rough surface to scatter incident light.

When the light scattering part 40 is formed on the inducing lens part 20, the lamp part 10, the inducing lens part 20 and the adjusting lens part 30 may be mounted on the vehicle body. At this time, the lamp part 10 and the inducing lens part 20 may be mounted on the light cover part 50, and the light cover part 50 may be mounted on the vehicle body.

In such a state, when the lamp part 10 is turned on, light straightly moved by the inducing lens part 20 may be induced to a target position while passing through the adjusting lens part 30, thereby becoming a low beam.

On the other hand, light incident on the cut surface 21 may be scattered by the light scattering part 40 to suppress a glare problem. Furthermore, the light cover part 50 covering the cut surface 21 may block light to prevent a glare problem.

In the lighting device 1 for a vehicle in accordance with the embodiment, the cut surface 21 may be formed by processing the inducing lens part 20, and the light scattering part 40 may be formed on the cut surface 21, thereby preventing a glare problem.

The lighting device 1 for a vehicle in accordance with the embodiment of the present invention can scatter light through the light scattering part 40 having a rough surface.

In the lighting device 1 for a vehicle in accordance with the embodiment of the present invention, the light cover part 50 may cover the cut surface 21 so as to restrict movement of incident light through the cut surface 21.

Although preferred embodiments of the invention have been disclosed for illustrative purposes, those skilled in the art will appreciate that various modifications, additions and substitutions are possible, without departing from the scope and spirit of the invention as defined in the accompanying claims.

What is claimed is:

1. A lighting device for a vehicle, comprising:

a lamp configured to irradiate light;

an inducing lens configured to guide the light irradiated from the lamp, and the inducing lens comprises a cut surface formed thereon;

an adjusting lens formed at the front of the inducing lens, and configured to adjust a direction of the light moved through the inducing lens; and a light scatterer formed on the cut surface to prevent glare caused by light incident on the cut surface, wherein the lamp is located on a plane that is substantially parallel to the adjusting lens, and an angle formed by the cut surface and the plane form a substantially obtuse angle as measured at the lamp.

2. The lighting device of claim 1, wherein the inducing lens comprises a multi-stage total internal reflection lens, and the cut surface is formed to correspond to a size of the adjusting lens.

3. The lighting device of claim 2, wherein the cut surface comprises an outer cut surface and an inner cut surface.

4. The lighting device of claim 3, wherein the outer cut surface is formed to connect the inducing lens and the adjusting lens to each other on a plane, the inducing lens comprises an upper end portion, a lower end portion, a left end portion, and a right end portion, the upper end portion, the lower end portion, the left end portion, and the right end portion are cut so a size of the inducing lens on the plane corresponds to a size of the adjusting lens on the plane.

5. The lighting device of claim 3, wherein an inner end portion of the inducing lens is cut to form the inner cut surface, so a size of the inner end portion corresponds to a size of the lamp.

6. The lighting device of claim 2, wherein the cut surface comprises a layered cut surface, and the layered cut surface comprises faults formed on the total internal reflection lens.

7. The lighting device of claim 1, wherein the adjusting lens forms a low beam pattern by adjusting the direction of light through multiple surfaces.

8. The lighting device of claim 1, wherein the light scatterer is disposed on the cut surface, and the light scatterer comprises a rough surface.

9. The lighting device of claim 8, wherein the light scatterer has a surface roughness of 15 to 70 μm.

10. The lighting device of claim 1, further comprising a light cover surrounding the inducing lens, the light cover configured to restrict movement of light incident on the cut surface.

11. The lighting device of claim 10, wherein the light cover comprises:

a cover housing comprising the lamp mounted therein; and a cover prevention part mounted on the cover housing, and covering the inducing lens and the adjusting lens.

* * * * *